US008373366B2

(12) United States Patent
Baaijens et al.

(10) Patent No.: US 8,373,366 B2
(45) Date of Patent: Feb. 12, 2013

(54) USER INTERFACE FOR SCENE SETTING CONTROL WITH LIGHT BALANCE

(75) Inventors: Johannes Petrus Wilhelmus Baaijens, Eindhoven (NL); Bram Francois Joosen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 391 days.

(21) Appl. No.: 12/812,034

(22) PCT Filed: Jan. 13, 2009

(86) PCT No.: PCT/IB2009/050116
§ 371 (c)(1),
(2), (4) Date: Jul. 8, 2010

(87) PCT Pub. No.: WO2009/090597
PCT Pub. Date: Jul. 23, 2009

(65) Prior Publication Data

US 2010/0277107 A1 Nov. 4, 2010

(30) Foreign Application Priority Data

Jan. 16, 2008 (EP) ..... 08100561

(51) Int. Cl.
*H05B 37/00* (2006.01)

(52) U.S. Cl. ..... 315/312; 315/295; 315/316

(58) Field of Classification Search ..... 315/291–295, 315/360, 362, 312, 316–319
See application file for complete search history.

(56) References Cited

U.S. PATENT DOCUMENTS

| | | | | |
|---|---|---|---|---|
| 4,727,296 | A | 2/1988 | Zaharchuk et al. | |
| 5,191,265 | A * | 3/1993 | D'Aleo et al. | 315/295 |
| 6,037,721 | A * | 3/2000 | Lansing et al. | 315/295 |
| 6,118,231 | A | 9/2000 | Geiginger et al. | |
| 6,169,377 | B1 * | 1/2001 | Bryde et al. | 315/294 |
| 2002/0193913 | A1 | 12/2002 | Pyle et al. | |
| 2004/0183475 | A1 | 9/2004 | Boulouednine et al. | |
| 2005/0248299 | A1 | 11/2005 | Chemel et al. | |
| 2006/0076908 | A1 | 4/2006 | Morgan et al. | |

FOREIGN PATENT DOCUMENTS

| | | | |
|---|---|---|---|
| EP | 0603936 | A1 | 6/1994 |
| WO | 2006008464 | A2 | 1/2006 |
| WO | 2009004531 | A1 | 1/2009 |
| WO | 2009081329 | A1 | 7/2009 |

OTHER PUBLICATIONS

"What Is Screen Setting"; iLIGHT Intelligent Controls, Article on the Architectural Application of a User Interface for Lighting Scenes, 3 Page Document, Downloaded From http://icanhome.comdownloads/iLIGHT%20Binder-SceneSet.pdf.

* cited by examiner

*Primary Examiner* — James H Cho
(74) *Attorney, Agent, or Firm* — Mark L. Beloborodov

(57) ABSTRACT

A user interface (240) includes buttons (410) associated with lighting scenes stored in a memory (230). Selection of one of the buttons (410) selects an associated lighting scene as a focus group including focus light sources, where the remaining light sources are included in a surrounding group. A contrast switch (430, 435) of the user interface (240) may be configured to change a ratio of the focus group to the surrounding group, and a brightness switch (440, 445) may be configured to change the intensity by multiplying by a factor focus intensity levels of the focus light sources and/or surrounding intensity levels of the remaining light sources.

10 Claims, 3 Drawing Sheets

USER INTERFACE FOR SCENE SETTING CONTROL WITH LIGHT BALANCE

RELATED APPLICATION

The present invention is related to European Patent Application Number EP07123858.8, filed on Dec. 20, 2007, entitled "Scene Setting Control for Two Light Groups," by Hans Baaijens and assigned to Koninklijke Philips Electronics N.V. , which is incorporated herein by reference in its entirety.

FIELD OF THE INVENTION

The present invention relates to devices, methods and systems for controlling light sources grouped in at least two groups to easily select and change scene setting parameters.

BACKGROUND OF THE INVENTION

Lighting systems are increasingly being used to provide an enriching experience and improve productivity, safety, efficiency and relaxation. Light systems are becoming more advanced, flexible and integrated for many domains including professional domains like the retail and hotel domains, as well as the home domain. This change is stimulated by the advent of LED lighting (Light Emitting Diodes or Solid State lighting). It is expected that LED lighting systems will proliferate due to increased efficiency as compared to today's common light sources, as well as to the ease of providing light of changeable light attributes, such as color and intensity.

Advanced lighting sources, systems and networks are able to provide light of desired attributes and preset light scenes. Conventional scene setting control is done by creating pre-sets that may be selected by a user. For example, a user create a desired scene by adjusting the settings (color, light intensity) of the individual light sources and store the result in the memory as new pre-sets or overwrite existing pre-sets.

In a room with more two or more light sources, several light scenes may be created. With controllable light sources that may be dimmable and color-changeable, a user has the opportunity of creating a dazzling number of scenes in a space. In order to support and facilitate different activities in a room with the right light, users or people need some freedom to manipulate the light scene, e.g., to change the light output and the light balance among the different light sources. Accordingly, it is desirable to allow setting comfortable and pleasing scenes in an intuitive way without too much difficulty or training.

If these light sources are dimmable and the number of light sources increases such as above five, the number of possible scenes increases enormously. Traditionally, light scenes are created by setting the dimming or intensity level of each light fixture separately. Untrained users typically have difficulty finding the optimum setting. Further, control of individual light sources is tedious.

A straightforward solution for controlling light scenes is individual control of each light source, lamp or fixture, as is often the practice in the home, such as in living rooms, or by using pre-sets as is the case in commercial buildings, like offices and shops. However, individually controlling light sources, and fine-tuning all the dimmable lamps, to achieve or choose desired settings is complicated, particularly for five or more lamps. Also, without training, the result might be non-optimal. Further, although pre-sets are simpler to use, however customization is not possible.

Conventional user interfaces for lighting control include defining, selecting and changing light scenes, as described in U.S. Patent Application Publication No. 2002/0193913 to Pyle, which is incorporated herein by reference in its entirety. Another user interface for lighting control includes graphically representing a view of a space to be lit, as described in European Patent Application Number EP 07111416.9, filed on Jun. 29, 2007, assigned to Koninklijke Philips Electronics N.V., which is incorporated herein by reference in its entirety. Other lighting control systems include independently controlling light sources as described in International Patent Publication WO 2006/008464 to Summerland, which is incorporated herein by reference in its entirety. Further lighting control systems include dividing a lighting network with addressable light sources into zones for easier control and creation of light scenes, including execution of lighting programs or scripts to provide desired scenes, as described in U.S. Patent Application Publication No. 2006/0076908 to Morgan which is incorporated herein by reference in its entirety.

In addition, U.S. Patent Application Publication No. 2004/0183475 to Boulouednine, which is incorporated herein by reference in its entirety, describes controlling two groups of light sources, namely, where a first power source controls two lights sources of the first group for providing two colors, and a second power source controls a third lights source of the second group for providing a third color. One controller is provided for controlling both power sources, while a second controller is provided for controlling only the second power source. In another lighting control system is described in U.S. Pat. No. 6,118,231 to Geiginger, which is incorporated herein by reference in its entirety, the total luminosity or brightness in a room is adjusted by changing a 'volume' parameter, and the ratio between light intensities of two light sources or groups of light sources is adjusted by changing a 'balance' parameter. This is achieved by adding or subtracting a value dS to parameters of the two sets of light sources or groups. In particular, when dS is added to both sets ($dS_1=dS_2$), then the total brightness is increased with no change in the ratio, and when dS is added to one set and subtracted from another set (dS1=−dS2), than the ratio is changed with no change in overall brightness.

Despite such advances, there is a need for a more intuitive scene setting control systems and methods that enable fast and comfortable creation of light scenes by untrained users and avoid the tedious way of controlling individual light fixture settings and customizing light scenes.

Accordingly, there is a need for simple light control systems that control grouped light sources to change the light attributes of the light groups to allow simple selection and customizing of light scenes.

SUMMARY OF THE INVENTION

One object of the present systems and methods is to overcome the disadvantages of conventional control systems.

According to one illustrative embodiment, a user interface includes buttons associated with lighting scenes stored in a memory. Selection of one of the buttons selects an associated lighting scene as a focus group including focus light sources, where the remaining light sources are included in a surrounding group. A contrast switch of the user interface may be configured to change a ratio of the focus group to the surrounding group, and a brightness switch may be configured to change the intensity by multiplying by a factor focus intensity levels of the focus light sources and/or surrounding intensity levels of the remaining light sources. The focus light sources have individual focus intensity levels related to each other according to a first relationship, and the remaining light sources have individual surrounding intensity levels related to each other according to a second relationship. The contrast switch may be configured to change the ratio without changing the first relationship and the second relationship.

Further areas of applicability of the present devices, systems and methods will become apparent from the detailed description provided hereinafter. It should be understood that the detailed description and specific examples, while indicating exemplary embodiments of the systems and methods, are intended for purposes of illustration only and are not intended to limit the scope of the invention.

BRIEF DESCRIPTION OF THE DRAWINGS

These and other features, aspects, and advantages of the apparatus, systems and methods of the present invention will become better understood from the following description, appended claims, and accompanying drawing where:

DETAILED DESCRIPTION OF EMBODIMENTS

The following description of certain exemplary embodiments is merely exemplary in nature and is in no way intended to limit the invention, its applications, or uses. In the following detailed description of embodiments of the present systems and methods, reference is made to the accompanying drawings which form a part hereof, and in which are shown by way of illustration specific embodiments in which the described systems and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of well-known devices, circuits, and methods are omitted so as not to obscure the description of the present system.

The following description of the light control devices, systems and methods include situations related to dimming or changing intensity and/or color values of lights sources divided in groups, such as a focus group and a surrounding group, to provide a desired, balance, contrast or light effect that defines a particular scene(s). The devices, systems and methods are applicable to home spaces such as living room, kitchen, bed room, bathroom, hotel rooms, shops, and other residential, retail or commercial spaces.

User Interfaces are provided for intuitive scene setting control with the possibility to customize individual scenes with changing the light balance between a focus area and all of its surroundings. The following description is related home living rooms and hotel rooms. However, it should be understood that similar user interfaces may be used for light scene selection and customization for any type of room or space, such as shops, bathrooms, kitchen, bed rooms, restaurants, offices, meeting rooms, lobbies, reception rooms, etc.

Figure 1:
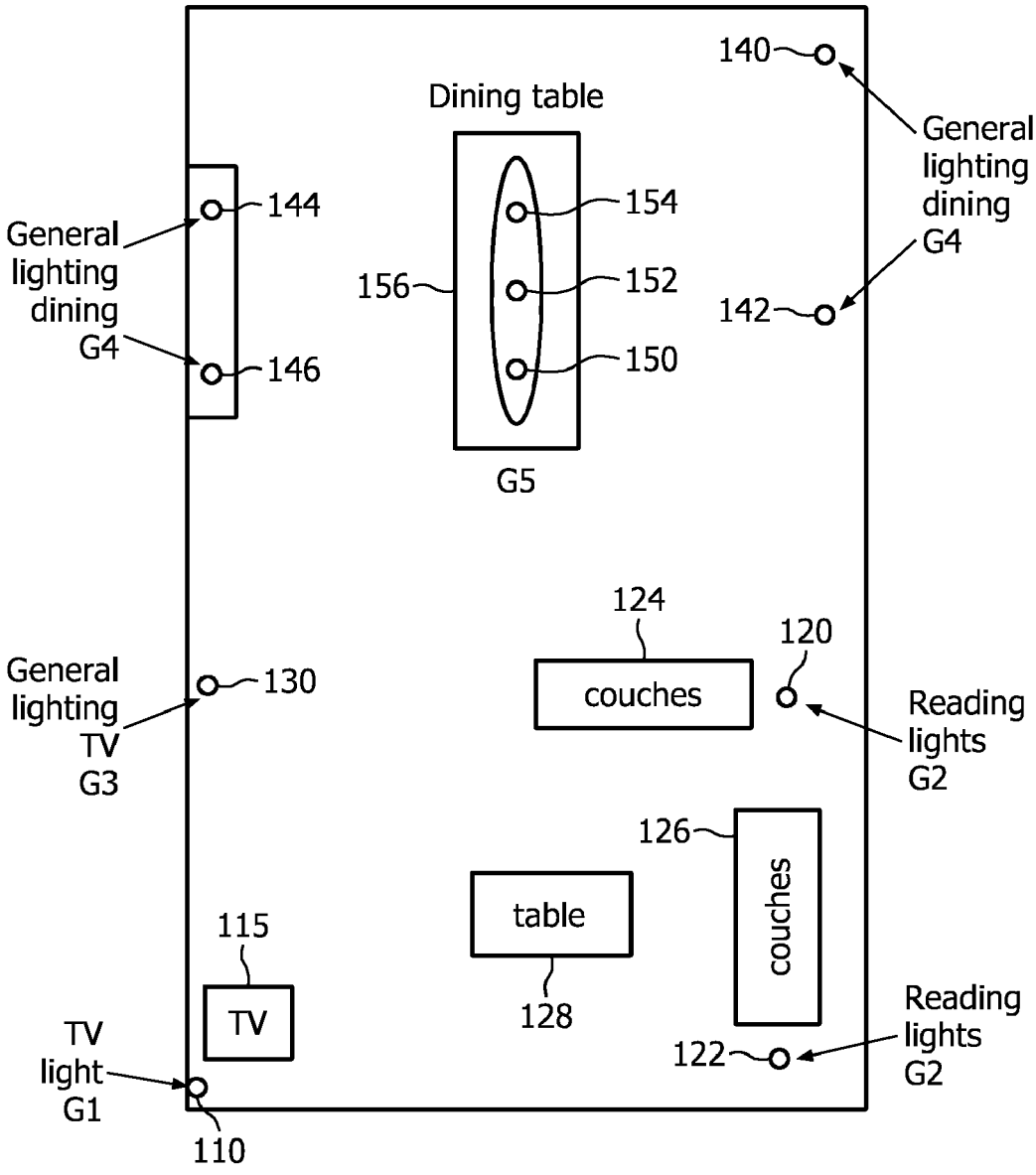
FIG. 1 shows a map of a space including light sources for illumination light areas and providing light scenes according to one embodiment.

In a single space such as a living room 100 shown in FIG. 1, the light fixtures are selectively connectable in groups e.g., via any type of connection and/or network such as wired or wireless. The groups may be pre-selected and/or selectable by a user. Illustratively, four different groups G1, G2, G3, G4, G5 are shown in FIG. 1, each supporting a main light effect for a certain area in the space. For example, the following lamps or light fixtures may be grouped as follows: group G1 includes a television (TV) light 110 near a TV 115; group G2 includes reading lights 120, 122 near couches 124, 126 and/or a small table 128; group G3 includes general lighting of one or more lamps 130 for the TV area; group G4 includes general lighting of one or more lamps 140, 142, 144, 146 for a dining room area; and group G5 includes dining table lights 152, 152, 154 near a dining table 156. Of course any alternate or additional light sources or lamps may be provided for any room or space and grouped in various groups selectable by a user.

Figure 2:
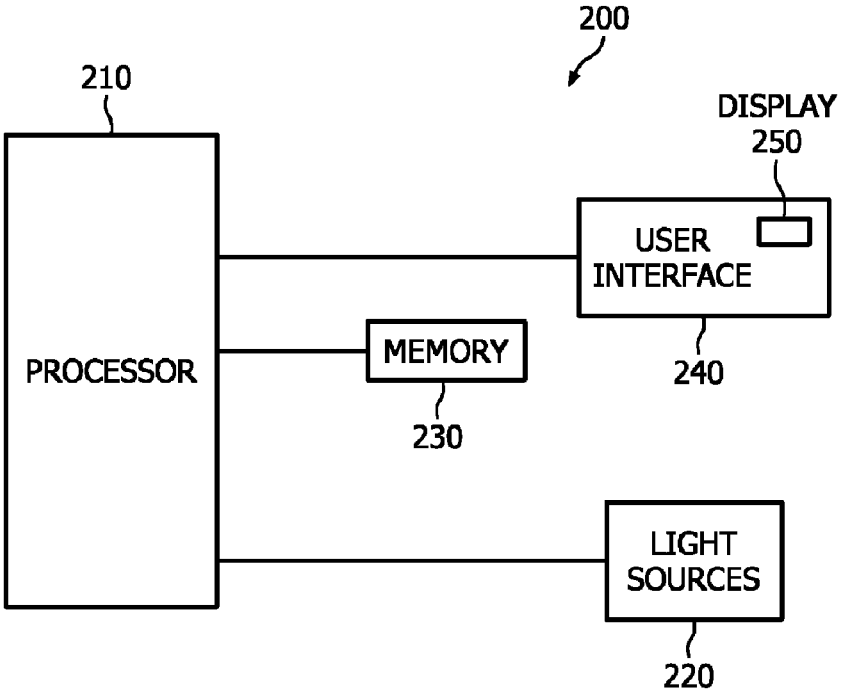
FIG. 2 shows an illustrative light control system according to one embodiment.

FIG. 2 shows a light control system 200 according to one embodiment that includes a processor 210 operationally coupled to and configured to control controllable light sources shown collectively as reference numeral 220. The processor may also be operationally coupled to a memory 230 which stores various pre-sets, light scenes, scripts, application data and other computer readable and executable instructions for execution by the processor 210 in order to control the light sources 220. The processor or controller 210 may be further configured to control the light sources 220 to change light attributes such as intensity and/or color, for example, in accordance with one or a combination of the described methods including changing the ratio between focus and surrounding groups, as well as the ratio or relationship (e.g., of dimming/intensity and color values) of light sources included in a group, such as the focus group and/or the surrounding group. The processor or controller 210 may be also be configured to change the total intensity of a scene, e.g., by changing the intensity of the focus and/or surrounding group. The processor 210 may be further configured to change the intensity of one or more light sources in the focus and/or surrounding group. Such operations may be stored as computer readable and executable instructions in the memory 230 for execution by the processor 210.

The light sources 220 may be grouped to be in the focus group and the surrounding group to define a scene which may be stored for selection and control by a user. The relationship between or among the light sources in each group may also be stored as part of the pre-set stored scenes. For example, one pre-set stored scene may be a reading scene, where the reading light sources 120, 122 are in the focus group F and have the following dimming or intensity values F[0.9, 0.8], i.e., 9:8 ratio or relationship. The remaining light sources are deemed to be in the surrounding group S. For simplicity, assuming there are five light sources in the surrounding group S, the five surrounding light sources for the pre-set and stored reading scene may have the following pre-set relationship or dimming/intensity values S[0.7, 0.3, 0.5, 0.9, 0.1], for example. Illustratively, the reading scene may have the following scene illumination ratio SIR between the focus group F and the surrounding group S, [60% F, 50% S], as shown by point or scene A in FIG. 3. Illustratively, 60% F means that at least one of the maximum dimming levels in the focus group is 0.60 and 50% S means that at least one of the maximum dimming levels in surroundings group is 0.50. Of course, if desired, instead of at least one dimming level, the 60% F or the 50% S may be reprogrammed or defined to mean that all the maximum dimming levels in F and S are at 0.60 and 0.50, respectively.

Figure 3:
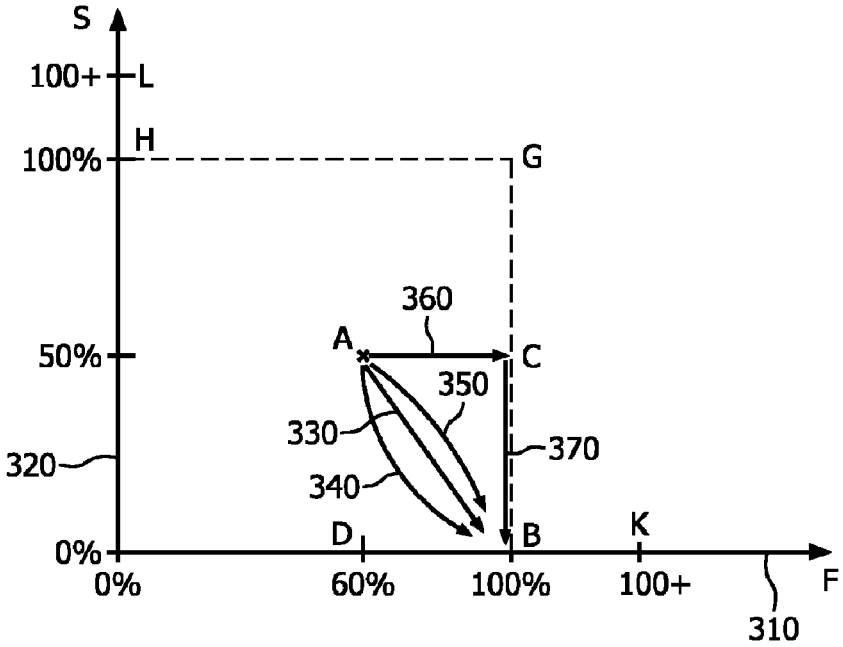
FIG. 3 shows a scene diagram of % focus versus % surroundings according to a further embodiment.

FIG. 3 shows a scene diagram where the percentage of the focus group F is shown on the x-axis 310 and the percentage of the surrounding group is shown on the y-axis 320, where 100% is defined as any lamp in the group operating at 100% or maximum intensity or brightness. Greater levels indicated as 100+ refer to the case where all light sources in a group are at their or maximum brightness levels. FIG. 3 shows a pre-set, selected or a starting scene A at coordinates F=60% focus, S=50% surrounding, resulting in a scene ratio SIR of 60/50. It should be noted that F+S need not equal 100.

When a user desires to change the starting scene A to an end scene B, e.g., with coordinates F=100% focus, S=0% surrounding, then several paths may be followed, which may be direct paths where the focus and surrounding values F, S are changed simultaneously. The direct paths may be provided by a linear path 330 using linear interpolation, or via non-linear paths 340, 350 using non-linear interpolation, for example. Alternatively, indirect paths may be followed through intermediate scenes C or D, where the focus and surrounding values F, S are changed sequentially.

It should be noted that the coordinates (% focus, % surroundings) do not uniquely define the state of the lights, where the coordinates are combined with the dimming levels of the light sources in the focus and/or surroundings groups to form or define a scene which may be stored in the memory 230, e.g., as pre-set scene. For example, point G in FIG. 4 (or point 2 in FIGS. 8 and 10-13) is at (100% focus, 100% surroundings); however different scene settings or states may be included for point G, such as defined by different intensity or dimming values in one or both the focus and surroundings groups. For example, two different focus scenes F1, F2, may be associated with point G or 100% focus, where F1=[0.7, 1, 0.3] and F2=[0.7, 1, 1]; thus both F1, F2 have % focus equal 100%, but F1 is not equal to F2. Such states may also depend on the pre-set of light settings that are multiplied with a factor R or 1/R, for example.

Figure 4:
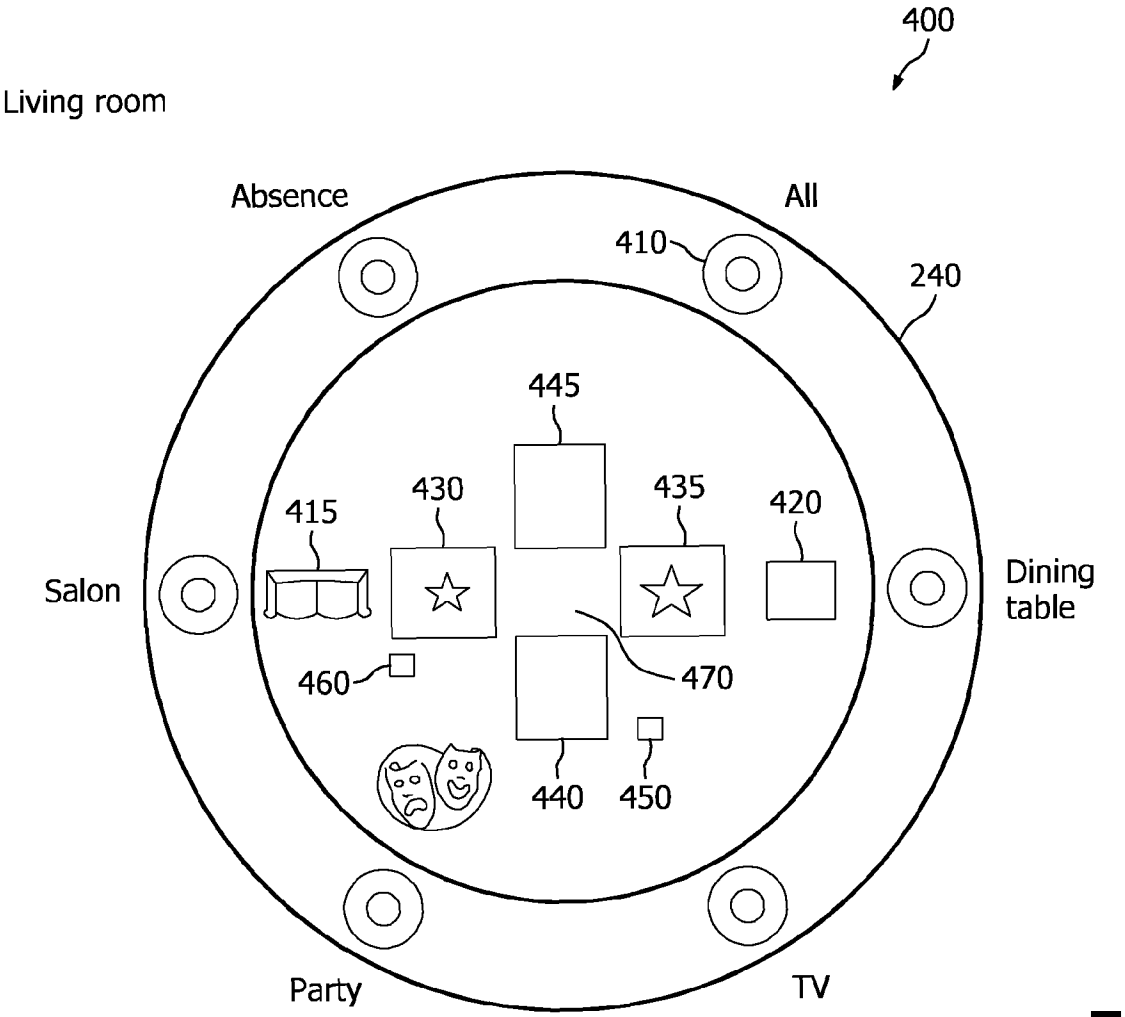
FIG. 4 shows illustrative control devices according to further embodiments.

Returning to FIG. 2, the user interface (UI) 240 may be, for example, located near one of the light sources 220, on a hand-held remote controller, on a wall, and/or may include hard or soft switches and indicators, e.g., sliders, buttons or rotary knobs 410, 430, 435, 440, 445, 440, 450, 460 shown in FIGS. 4-5. The entire user interface or portions thereof, such as certain switches and/or indicators may be displayed on the display screen 250 for control with any input device, such as a mouse or pointer in the case the screen is a touch sensitive screen. For example, touch sensitive elements (e.g., capacitively coupled strips or circular elements) of the user interface may be used to provide user input, such as to select stored scenes graphically represented, such as via icons and/or identifying words or symbols, as will be described in connection with FIGS. 4-5.

The controller 210 may include any type of processor, controller, or control unit, for example. The controller or processor 210 is operationally coupled to controllable light sources 220, which may be configurable to provide any type of light, such as direct or indirect light, having any desired attribute. Illustratively, the controllable light sources 220 include Light emitting diodes (LEDs) for controlling and changing attributes of light emanating therefrom. LEDs are particularly well suited light sources to controllably provide light of varying attributes, as LEDs may easily be configured to provide light with changing attributes, such as intensity, colors, hue, saturation, direction, focus and other attributes that may be controlled by the processor 210. Further, LEDs typically have electronic drive circuitry for control and adjustment of the various light attributes. However, any controllable light source may be used that is capable of providing lights of various attributes, such as different colors, hues, saturation and the like, such as incandescent, fluorescent, halogen, or high intensity discharge (HID) light and the like, which may have a ballast or drivers for control of the various light attributes.

It should be understood that the various components of the lighting control system 200 may be interconnected through a bus, for example, or operationally coupled to each other by any type of link, including wired or wireless link(s), for example. Further, the controller 210 and memory 230 may be centralized or distributed among the various system components where, for example, multiple LED light sources 220 may each have their own controller and/or memory.

Of course, as it would be apparent to one skilled in the art of communication in view of the present description, various further elements may be included in the system or network components for communication, such as transmitters, receivers, or transceivers, antennas, modulators, demodulators, converters, duplexers, filters, multiplexers etc. The communication or links among the various system components may be by any means, such as wired or wireless for example. The system elements may be separate or integrated together, such as with the processor. As is well-known, the processor executes instruction stored in the memory, for example, which may also store other data, such as predetermined or programmable settings related to system control.

As described in the related European Patent Application Number EP07123858.8, filed on Dec. 20, 2007, entitled "Scene Setting Control for Two Light Groups," by Hans Baaijens and assigned to Koninklijke Philips Electronics N.V. a scene control device may be simplified to include certain control options, such as focus or activity group selection, where the non-selected light sources are deemed to be in the surrounding group. FIG. 4 shows a control device 400 that includes the user interface 240 shown in FIG. 2. The control device 400 has a number of scene buttons 410, with an LED that lights up when a button is pressed, for example, which selects a preset light scene or script (stored in the memory 230 and) associated with the activated button as the focus group. Of course, multiple buttons may be activated to include multiple light scenes in the focus group. The pre-sets with icons may be ordered around a circular border of the user interface 240 to match the order of focus areas in the space, for example, to provide stylistic and abstract representation of the space.

In addition to focus group selection by activating one or more of the buttons 410, the control device 400 may be further configured to provide light balance variation between the focus group F and the surroundings group S by controlling the scene illumination ratio SIR=F/S, e.g., via contrast switches 430, 435 shown in FIG. 4. For example, activating the contrast switches 430, 435 may change a scene, where the focus group F is multiplied with a factor R and the surrounding group is multiplied with factor 1/R. The contrast switches 430, 435 may be configured to change the SIR through direct or indirect path.

When both the focus and surrounding groups are changed simultaneously, then a direct path is followed between two end points A, B, such as linear or non-linear direct paths 330, 340, 350 shown in FIG. 3. Of course, when the both the focus and surrounding groups are changed sequentially, then an indirect path 360, 370 is followed through an intermediate point C.

It should be noted that multiplying the focus and surrounding groups F, S by R and 1/R, respectively, maintains the ratio among the individual light sources within the group in the case where the maximum 1 is reached for one of the light sources. However, the ratio SIR=F/S between the focus and surrounding groups F, S changes. Maximum contrast between the focus and surrounding groups F, S when F is at the extreme maximum, designated as 100+ in FIG. 3 where all the light sources in the focus group F are at intensity 1, and S is at minimum such as 0% (designated as point K in FIG. 4), where all the light sources in the surrounding group S are at minimum intensity such as 0, or when S is at the extreme maximum 100+% and F is at 0%, (designated as point L in FIG. 3 where all the light sources in the surrounding group S are at the maximum intensity 1). It should be noted that a minimum dimming value other than 0 may be used, such as 0.1, as lights source may not be dimmable to 0, which is typically the case when the lights are off. Of course, light sources may be turned off, instead of being dimmed to minimum level, to achieve a desired scene.

In addition or instead of multiplication, linear or non-linear interpolation may be used through direct or indirect paths between end points B and H shown in FIG. 3, such as indirect paths B-G and G-H, between B (100% focus, 0% surroundings) and H (0% focus, 100% surroundings). For example, the indirect path may pass through intermediate point G, namely, (100% focus, 100% surroundings).

Illustratively, linear interpolation may be used to change scene B (100% focus, 0% surroundings) to scene G (100% focus, 100% surroundings), using N (for example in 10, 50, or 100) equal steps between 0% surroundings and 100% surroundings, at constant or 100% focus. Next, scene G (100% focus, 100% surroundings) is changed to scene H (0% focus, 100% surroundings) in N (for example in 10, 50 or 100) equal steps between 100% focus and 0% focus, at constant or 100% surroundings. Instead of linear interpolation with N equal increments or steps, exponential distribution of dimming increments or steps may be used similar to the Digital Addressable Lighting Interface (DALI) standard, such as N (10, 50 or 100), since human perception allows taking large steps when the light output increases.

Additionally, it is possible, to 'extrapolate' a scene, where dimming/intensity values are increased in the focus group until all the focus lights (i.e., the lights in the focus group) have a dimming/intensity value of 1 or a maximum. Similarly, the dimming/intensity values in surroundings group are decreased until all the surrounding lights (i.e., the lights in the surrounding group) have the minimal dimming/intensity value, e.g., 0.1.

As shown in FIG. 4, the user interface 240 may further include total light output or dimming control, e.g., via dimming or intensity control switches 440, 445. Of course, the dimming values or the relationship among individual light sources in one group may also be controlled, e.g., upon activation of a selected light mode switch 450 and control of the selected light source via one of the UI switches, such as via the dimming switches 440, 445 to change the brightness of the selected light source.

The scene buttons 410 of the control device 400 shown in FIG. 4 may be ordered in a circular shape and have indications associated with light scenes. The indications near each button may be a pictogram, icon, or text to show the activity or focus group(s) that is selected. That is, the icons or identifying text near the buttons 410 are related to the pre-set light scenes stored in the memory 230 and associated with the particular buttons 410, such as a couch icon 415 indicating a salon or living room scene, a square icon 420 indicating a dining room table, as well as TV and party icons, for example. Further, an Absence and All icons and buttons may also be provided.

The Absence button may be selected when no one is at the premises to provide a dynamic light scene that turns different lights on and off according to a time scheduled light scene, for example, to provide the appearance that the premises are occupied and thus scar thieves away, typically useful in a home environment. Activating, the All button turns on all the lights, for example, or a selected set of the lights. The other buttons (dining table, salon, TV, desk, chair, bed) are straightforward and indicate a certain activity/area in the space. The light fixtures may be controlled in groups, such as a group near the TV, e.g., a first group G1 with at least one light source 110 shown in FIG. 1, a second group G2 in the salon or the living room with one or more light sources 120, 122, and the like.

The icons and indications shown in FIG. 4, namely, Absence, All, Dining Table, TV, Party, Salon, are suitable for a home environment. In a hotel environment, the icons and indications may be Absence, All, TV, Desk, Chair, Bed, for example. Of course, different light scenes may be selected for display on the user interface by accessing the memory 230 and associating desired stored scenes with particular buttons of the user interface, where the associated icons or text may also displayed on a display screen near the buttons. Portions or the entire user interface may be displayed on a display, such as a touch sensitive display, for display of the icons, as well as display of the buttons, sliders and switches in the case of software buttons, sliders, switches and the like.

The icons or indicators may be ordered such that the control device 400 is rotationally symmetric, (i.e., has no top or bottom). Of course, instead of a circular shape, other shapes may also be used such as rectangular, triangular, oval, etc. In between the activity buttons, two sets of buttons, switches, knobs, or sliders may be provided, which may be touch sensitive, for example. One set of switches may be for contrast variation and control, such as horizontally arranged switches 430, 435, and another set of switches 440, 445 (e.g., vertically arranged) may be for total brightness variation and control where, for example, activating the bottom switch 440 decrease or dims the total brightness and activating the top switch 445 increases total brightness.

In one contrast mode which may be the default mode, the contrast switches 430, 435 may be configured to change the scene illumination ratio SIR=F/S between the focus group F and the surrounding group S, such as starting from a preset scene A shown in FIG. 3, associated with a scene selected by pushing one of the buttons 410, for example. Activating one of the contrast switches, such as the left switch 430 (or sliding a slider switch to the left), moves the selected pre-set starting scene A towards one end-point, such as point or scene H having coordinates (0 Focus; 100% Surrounding) or any other desired point such as (100+ Focus; 0 Surrounding). Similarly, activating the other contrast switch, such as the right switch 435 (or sliding a slider switch to the right), moves the selected starting scene A towards another end-point, such as point or scene B having coordinates (0 Focus; 100% Surrounding) or any other desired point, such as (0 Focus; 100+ Surrounding). Such changes in the ratio SIR may be either via direct and/or indirect paths using multiplication, interpolation and/or extrapolation, for example. For example, a direct path includes changing both the focus and surrounding groups simultaneously, where the indirect path includes changing either the focus group or the surrounding group, including changing the focus or surrounding groups sequentially.

In other contrast modes, the contrast slider or switches 430, 435 may be configured to individually change the amount, e.g., percentage, of either the focus or the surrounding group. The different contrast modes may be selected by activating a contrast mode button 460, for example, which may cycle through the various contrast modes and display an indication of the current contrast mode. For example, (1) R may be displayed (on or near the contrast slider or switches 430, 435, or on the contrast mode button 460) to indicate the ratio mode, where the ratio SIR is changed toward pre-selected (and programmable) end-points H, E, using the contrast slider or switches 430, 435;

(2) F may be displayed to indicate the Focus mode, where the Focus percentage is changed only, without any change in the Surrounding percentage (e.g., the numerator F of the ratio SOR=F/S is changed) when the contrast slider or switches 430, 435 are activated, thus changing the starting scene along a horizontal line, such as path 360 shown in FIG. 3; and (3) S may be displayed to indicate the Surrounding mode, where the Surrounding percentage is changed only, without any change in the Focus percentage (e.g., the denominator S of the ratio SIR=F/S is changed) when the contrast slider or switches 430, 435 are activated, thus changing the starting scene along a vertical line, such as path 370 shown in FIG. 3. For the default contrast mode which may be preset and/or programmable, a D may be displayed on or near the contrast mode button 460. Of course, any other symbols or icons may be displayed for indicating the current contrast mode.

Various brightness modes may also be provided for changing the total brightness via the vertical slider or switches 440, 445, selectable via the brightness mode button 450, for example. In the default brightness mode, where a D may be displayed on or near the brightness mode button 450 and/or on or near the brightness or dimming switches 440, 445, both the focus and surrounding groups are multiplied by the same factor R in response to activating the vertical slider or switches 440, 445, where the value of R changes between minimum and maximum values. The minimum value may be when one of the light sources in one or both the focus and surrounding groups reaches a minimum value such as 0 or 0.1. Alternatively, the minimum value may be when all of the light sources in one or both the focus and surrounding groups reach a minimum value such as 0 or 0.1.

Similarly, the maximum value may be when one of the light sources in one or both the focus and surrounding groups reaches a maximum value such as 1. Alternatively, the minimum value may be when all of the light sources in one or both the focus and surrounding groups reach a maximum value such as 1.

In another mode which may be defined as a further brightness or contrast mode, where an I for 'inverse" may be displayed on or near the brightness mode button 450, the focus group is multiplied by a factor R and the surrounding group are multiplied by the inverse factor, i.e., 1/R, in response to activating the vertical slider or switches 440, 445, where the value of R changes between a minimum and a maximum value. The minimum value may be when one of the light sources in one or both the focus and surrounding groups reaches a minimum value such as 0 or 0.1. Alternatively, the minimum value may be when all of the light sources in one or both the focus and surrounding groups reach a minimum value such as 0 or 0.1. It should be noted that, since the focus group is multiplied with R and the surroundings group with 1/R, this particular mode may be better defined as another contrast mode (instead of a brightness mode).

As described, upon selection of a focus group by activating one of the buttons 410, where light sources associated with the selected focus group as stored in the memory 230 (FIG. 2) are selected, the remaining light sources associated with the remaining groups are deemed to be in the surrounding group. Of course, for certain activities more than one group of lights may be selected for the focus area or to be in the focus group. Thus, the focus group may include more than one group. The surrounding area or group includes all other light sources that are not part of the selected focus area(s) or group(s).

Accordingly, the user may select multiple activities or light scenes/scripts to be included in the focus group, for example to meet demands of multiple users that are simultaneously in the space. For example a short press, e.g., 1 second hold on a button selects one focus activity, and a longer push, e.g., 3 seconds hold, adds a new focus area to the previous selected button or focus group. Thus, the final focus group includes two activities or two groups. It should be noted that the more activities are simultaneously selected and included in the final focus group, the weaker the contrast variation between the final focus group and the surroundings group.

It should be noted that when multiple pre-sets (or activities/focus groups, such as Reading, TV, Dining Table etc.) are selected to form a combined focus group, the pre-set state of the surroundings group associated with the final or combined focus group may be defined in several ways. The final surroundings group associated with the combined focus group, also referred to as a combined surroundings group, may be achieved in different ways, e.g., by changing the states of light sources in the current surroundings group in response to adding another activity group to the combined focus group. For example, the following several options may be used for defining the pre-set state of the surroundings groups:

- Pre-set of the remaining lights that form the combined surroundings group is set by the pre-set of the surroundings group in, or associated with, the first selected pre-set, activity or focus group;
- Pre-set of the remaining lights that form the combined surroundings group is set by the pre-set of the surroundings group in, or associated with, the last selected pre-set, activity or focus group; and/or
- Pre-set of the remaining lights that form the combined surroundings group is set by the average of all pre-sets of the surroundings group in, or associated with, all the selected pre-sets, activities or focus groups.

Of course, when there are multiple control/UI devices 400 for controlling light settings in the same space, then the multiple control/UI devices need to be interconnected. Each device is configured to show the current status, or is set in non-active mode to make clear which device is in control.

As described, the balance variation control, such as via the balance or contrast slider or buttons 430, 435 allows changing the scene illumination ratio SIR between the light output at the position of the selected main activity/area (i.e., the percentage of the focus group F) and the light output of all the other light fixture groups (i.e., the percentage of the surroundings group S). To enable maximum customization of the scene with this option, the highest setting upon activation of the right or increase contrast button 435 may be "focus" at 100%+ and "surroundings" at 0%, as shown by scene setting or point K in FIG. 3. The lowest setting obtained by activating the left or decrease contrast button 430 may be "focus" at 0% "surroundings" 100%+, as shown by scene setting or point L. Of course, if desired, the maximum setting may be at point or scene B (100% focus, 0% surroundings) and the minimum setting may be at point or scene H (0% focus, 100% surroundings). It should be noted that boundary B-G in FIG. 4 may also be characterized as F=100+, meaning that all lights in focus group are at 100%; and boundary H-G may also be characterized as S=100+, meaning that all lights in surroundings group are at 100%. Similarly, the value F=0% may be defined as all lights (instead of at least one light) in the focus group at 0%, and S=0% may be defined as all light in the surroundings group at 0%.

The middle setting may be "focus" at 100% and "surroundings" at 100% as shown by scene setting or point G in FIG. 3 and may be obtained by activating a dedicated button, such as button 470 shown in FIG. 4. All in-between settings (between lowest and middle setting and between middle and highest setting) may be made by interpolation, e.g., linear or non-linear interpolation, to provide direct paths between these extremes, such as similar to the direct paths 330, 340, 350 shown in FIG. 3. In the case of direct paths, both the focus and surrounding group values or percentages are changed simultaneously. Of course, indirect paths may also be used between two points or scene setting where the focus and surrounding group values or percentages are changed sequentially (instead of simultaneously), as described in connection with FIG. 3. By changing the scene illumination ratio SIR=F/S (where the values for F and S are in percentages, for example, that do not necessarily add to 100), the contrast may be maximum, equal, or inverse, where inverse indicates that the surroundings group value or percentage is at a higher level than the focus group value.

If there are light fixtures with color temperature variability, a color variation control option may be added, to select the color temperature of all light fixtures simultaneously, e.g., via a color button(s), switch(s) or slider(s) similar to the other switches 430, 435, 440, 445, for example. Lamps that cannot create the whole range that is addressed, such as lamps that cannot provide a requested color, simply do not react. In the case where different lamps have the same capability for color variability, these lamps react similarly.

If during reduction of brightness or dimming, light fixtures or sources reach their minimum (or maximum) level, this level is held. That is, when the dimming/intensity level is decreased (or increased) further, the light sources that have reached their minimum (or maximum) level do not change. Further, when the brightness/dimming level is increased (or decreased) again above this minimum (or below the maximum) threshold, then the same ratio between, or relationship among, the dimming levels of all light fixtures within a group is regained.

It should be understood that besides hotel rooms and living rooms, the present system, method and user interface may be applied to any setting, such as restaurants, bars, shops, bathrooms, bedrooms, kitchen, offices, meeting rooms. Various elements may be operationally connected by any means, wired or wireless. For example, the light sources may be wirelessly controlled by the user interface of the control device to change different attributes of light provided from such light sources, such as intensity, color, directivity, saturation and the like. Of course, the present system may also be used to only turn on/off light sources, instead of changing light attributes such as intensity and color. This may be advantageous when a large number of light fixtures are used.

In one contrast mode, activating the contrast switches 430, 435 changes the scene illumination ratio SIR between the focus group F and the rest or the surrounding group S, where SIR=F/S, without changing the intensity ratio or relationship among individual focus and/or surrounding light sources. For example, the focus group F may be three light sources with the following intensity levels, F[0.8, 0.3, 0.7] while the surrounding group S may be three light sources with the following intensity levels, S[0.4, 0.6, 0.2, 0.9, 0.3]. The relationships among the individual focus and/or surrounding light sources define or are associated with a particular scene, e.g., a reading scene. When the processor 210 or the user changes the scene illumination ratio SIR by activating one of the contrast switches 430, 435 then, for example, the SIR changes from [90% focus, 60% surrounding] to [70% focus, 10% surrounding], which may be accomplished by multiplying the individual light intensities certain factors, to result in R1F[0.8, 0.3, 0.7] and R2S[0.4, 0.6, 0.2, 0.9, 0.3]. It should be noted that such an SIR change or multiplication does not change the relationship among the individual light intensities thus maintaining the scene effect, where the intensities of the light sources in the focus group are still related to each other by 8:3:7 and the intensities of the light sources in the surrounding group are still related to 4:6:2:9:3.

Similarly, activating the dimmer or intensity switches 440, 445 changes the brightness or intensity of scene formed by the focus and surrounding groups, the individual light relationships as well as without changing the scene illumination ratio SIR, thus maintaining the light effect associated with the scene, e.g., a dining table scene, where the focus group F is selected or preset to include dining table light sources 150, 152, 154 for group G5 shown in FIG. 1. Now, the dining table light sources 150, 152 provide brighter light than light provided by the light sources of the surrounding group S. For example, activating one of the dimmer switches 440, 445 multiplies both the focus and surrounding individual light intensities by the same factor, e.g., RF[0.8, 0.3, 0.7] and RS[0.4, 0.6, 0.2, 0.9, 0.3]. As described, both the scene illumination ratio IR and the scene intensity may be changed simultaneously to go from a starting scene to an end scene, such as indirectly (through intermediate scenes) or directly, without going through intermediate scenes as described in connection with FIG. 3.

In summary, the ratio or contrast switches 430, 435 are configured to provide variable light level ratio between main activity group (i.e., focus group 310), and all the other groups (i.e., surrounding group 320), and the dimming switches 440, 445 are configured to provide variable absolute light level of the main activity or focus group. In this way, the tedious setting procedure of each individual light source is reduced to controlling two variables. Also, processor executable instructions stored in the memory 230 are used to provide the best practice solution of professional lighting designers, thus resulting in high quality solution. The principle to have focus lights in a space with higher light levels, and surrounding lights with a lower light level, is an example of the best practice of lighting design. It should be understood that any type of switches may be used, such as sliding or rotary switched, and/or soft switches which may be displayed on the display device 250, for control with a mouse and/or pointer in the case of a touch sensitive screen 250.

As described, there are several ways to create the light balance between the focus area and the surroundings, upon selection of a contrast mode via the contrast mode button 460, and activation of the contrast switches 430, 435. After selecting or defining the focus group to include selected light sources, for example, or starting from a pre-stored scene, such as a reading scene, one method of changing scenes and creating a desired light balance or scene includes multiplication, by the same scalar/constant or different scalars, of intensity levels associated with the light sources of the focus group F, and the light sources of the surrounding group S.

It should be noted that initial dimming/intensity values, as well as color values, for each scene that fit to the needs of certain activities in the space (like dining), e.g., as made by the user during commissioning of the lighting system, are stored in memory 230, referred to as pre-sets for use as a starting point for each variation of scene or light balance.

In such a case, the light balance function to change scenes may be used by changing the SIR=F/S and either (1) changing the ratios or relationships among of all dimming/intensity levels of the light sources in one or both F and S groups, or (2) keeping constant the ratios of all dimming/intensity levels of the light sources in one or both F and S groups and scaling (e.g., multiplying) the dimming/intensity levels of one or both F and S groups by the same or different scalars (assuming that the light output of the light sources changes linearly with the changed dimming values).

(1) Changing the dimming/intensity level of each light source in the whole scene (focus+ surroundings), e.g., changing with a stepwise dimming value change S (upward or down ward), results in changes in the ratios of all dimming/intensity levels; that is the ratios of all dimming/intensity levels are not kept constant.

(2) To keep the ratios of all dimming/intensity levels constant, the following may be performed, where $R_f$ is the maximum dimming range in the scene in the focus group (being the difference between 1 and minimum dimming value $dim_{min}$ of the focus scene), and $R_s$ is the maximum dimming range in the scene in the focus group (being the difference between the maximum dimming value $dim_{max}$ in the surroundings group and zero):

(a) For the focus group: Change the dimming level of the light source that defines $R_f$ with a stepwise dimming/intensity value change S (upward or down ward); and calculate the dimming/intensity levels of all other light sources in the focus group from the initial dimming ratio (as long as the dimming value is not 1 or 0).

(b) For the surroundings group: Change the dimming level of the light source that defines $R_s$ with a stepwise dimming value change S (upward or down ward); and calculate the dimming levels of all other light sources in this group from the initial dimming ratio (as long as the dimming value is not 1 or 0).

In this way, the dimming ratios within the focus group and the surroundings group are kept as constant as possible. The advantage is that the focus group scene impression and the surroundings scene impression are kept constant as long as possible (like with normal dimming).

The described methods provide simple solutions, such as allowing the user to fine-tune the preset and changed or created light effect, e.g., using a dimmer (in combination with a color selector if the lights sources provide changeable color) located in the space near a light source. The dimmer switch may be a software controlled device, including a hardware and/or a soft switch displayed on a display, for example.

Selected preset scenes may be changed or fine tuned by the user via the user interface 240, such as activating the contrast switches 430, 435 to change the ratio between the total amount of light in the focus group and in the surroundings group, where the sum of the two groups is not kept constant. Thus, the ratio between the amount of light in the focus area relative to the amount of light in the surroundings area, for each of the pre-sets, may be easily controlled using the contrast switches 430, 435. Such methods and systems provide simple, intuitive and meaning full way to vary a light scene via a simple control method and user interface. The more light sources, e.g. larger than 3, then more practical benefits are realized. Such methods and systems allow a user to adjust the scene meaningfully without individual control of all light sources. By using the user interface 240, the user can very quickly adjust the scene, without tedious control of all different light sources, where the light-balance parameter pre-defines a certain control dimension. This is very advantageous in various situations and spaces, such as where:

(1) people are new to the space, the lighting user interface and control device, and spend relatively little time in the space such as a hotel room, so they have little or no time to learn, or do not want to spend time on learning;

(2) different people are using the same space, with different needs that cannot be satisfied with pre-sets only. e.g., at home spaces like the living rooms; and (3) in situations where the margin of error in selecting the correct scene or lighting parameters, such as in shops, where the shop personnel often is not qualified to make complete lighting scenes using complex controllers and user interfaces, but may easily and quickly learn how to adjust a light scene using the present systems, devices, user interfaces and methods.

The present systems, devices, user interfaces and methods are intuitive to use, extend the use of preset by providing meaningful and simple ways to change and fine tune the pre-sets to provide a desired scene. The present systems, devices, user interfaces and methods provide for scene creation by fine-tuning preset scenes, e.g., by controlling the ratio between the amount of light in the focus area relative to the amount of light in the surroundings area, for each of the pre-sets. This gives the user freedom, to create scenes that differ from the pre-sets in a meaningful way, giving the user the freedom to adjust to personal taste, time-of-day, time-of-the-year. For example, when a user is in a hotel room during a summer day where there is daylight in the room, the user may lower the surrounding light level (as compared to a winter day) to create a pleasurable atmosphere. In the winter time, the user may increase the surrounding light which is more appealing and meaningful when less daylight is in a room. Of course, the present systems, devices, user interfaces and methods are not limited to home or hotel use and may be used in any environment such as commercial, retail and office environment, as well as in restaurants, hospital rooms, waiting rooms, meeting rooms, etc.

The present systems, devices, user interfaces and methods may be configured to change scenes by various ways, such as by multiplication, interpolation and/or extrapolation, including simultaneous multiplication of both the focus and surroundings groups by the same or different scalars, (e.g., by R and 1/R, respectively), or multiplication of only one group, i.e., multiplying only either the focus group or the surroundings group, while keeping the other group constant. Interpolation may be performed, for example, using linear or logarithmic distributions. The dimming levels may be changed in linear steps or increments, or in logarithmic steps where the step size increases from small to large for dimming levels increasing from small to large. The logarithmic distribution gives a gradual change as perceived by human observers.

When changing a scene via interpolation, in each group ("focus" or "surroundings") one light source is leading, such as the one with the maximum dimming range between the two end points of the interpolation trajectory in the (% focus, % surroundings) space. Upon selection the leading light source, then interpolation is done between the two states for this leading light source first. The dimming levels of all the other light sources in the same group are calculated from the ratio between the dimming level of the leading light source and the dimming level of the particular light source, as illustrated by the following example.

Let the pre-set or starting point be focus=[0.1, 0.5, 0.3] and the desired end-point to be interpolated be focus=[0.2, 1, 0.6]. The leading light source is selected as the one having the highest dimming or intensity level, which is the second light source having a pre-set value of 0.5. Thus, the second or leading light in the focus group will be changed, e.g. via interpolation, from 0.5 to 1.0.

Take the intermediate value 0.75; the dimming factor is then 0.75/0.5=1.5. Then the total focus scene is 1.5*[0.1 0.5 0.3]. It is desirable to keep the dimming ratios between the different dimming levels within a group constant as long as possible, because this defines the impression of the scene by human observers.

Various modifications may also be provided as recognized by those skilled in the art in view of the description herein. For example, a display may not be necessary and the various switches may be hardware switches. The operation acts of the present methods are particularly suited to be carried out by a computer software program. The application data and other data are received by the controller or processor for configuring it to perform operation acts in accordance with the present systems and methods. Such software, application data as well as other data may of course be embodied in a computer-readable medium, such as an integrated chip, a peripheral device or memory, such as the memory 230 or other memory coupled to the processor 210.

The computer-readable medium and/or memory may be any recordable medium (e.g., RAM, ROM, removable memory, CD-ROM, hard drives, DVD, floppy disks or memory cards) or may be a transmission medium (e.g., a network comprising fiber-optics, the world-wide web, cables, and/or a wireless channel using, for example, time-division multiple access, code-division multiple access, or other wireless communication systems). Any medium known or developed that can store information suitable for use with a computer system may be used as the computer-readable medium and/or memory.

Additional memories may also be used. The computer-readable medium, the memory, and/or any other memories may be long-term, short-term, or a combination of long- and -short term memories. These memories configure the processor/controller to implement the methods, operational acts, and functions disclosed herein. The memories may be distributed or local and the processor, where additional processors may be provided, may be distributed or singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network, such as the Internet, is still within memory, for instance, because the processor may retrieve the information from the network.

The controllers/processors and the memories may be any type. The processor may be capable of performing the various described operations and executing instructions stored in the memory. The processor may be an application-specific or general-use integrated circuit(s). Further, the processor may be a dedicated processor for performing in accordance with the present system or may be a general-purpose processor wherein only one of many functions operates for performing in accordance with the present system. The processor may operate utilizing a program portion, multiple program segments, or may be a hardware device utilizing a dedicated or multi-purpose integrated circuit. Each of the above systems utilized for changing color may be utilized in conjunction with further systems.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same or different item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise;

h) no specific sequence of acts or steps is intended to be required unless specifically indicated; and i) the term "plurality of" an element includes two or more of the claimed element, and does not imply any particular range of number of elements; that is, a plurality of elements may be as few as two elements, and may include an immeasurable number of elements.

The invention claimed is:

1. A user interface comprising:

a plurality of buttons associated with lighting scenes stored in a memory, wherein selection of one of the plurality of buttons selects an associated lighting scene as a focus light group including focus light sources, wherein remaining light sources are included in a surrounding light group;

a contrast switch configured to change a ratio of the focus light group to the surrounding light group; and a brightness switch configured to change the total illumination intensity of the focus light group and the surrounding light group by multiplying by a factor both the focus group light intensity levels of the focus group light sources and surrounding group light intensity levels of the remaining light sources, wherein the focus group light sources have individual focus group light intensity levels related to each other according to a first relationship, and the remaining light sources have individual surrounding group light intensity levels related to each other according to a second relationship; and wherein the contrast switch (430, 435) is configured to change the ratio by multiplying the individual focus group light intensity levels by a factor (R) and simultaneously multiplying the individual surrounding group light intensity levels by an inverse of the factor (1/R) without changing the first relationship and the second relationship.

2. The user interface of claim 1, wherein the brightness switch is configured to change the total illumination intensity without changing the ratio, the first relationship, and the second first relationship.

3. The user interface of claim 1, wherein the brightness switch is configured to change the total illumination intensity without changing the ratio, the first relationship, and the second first relationship by multiplying by a factor both the individual focus group light intensity levels and the individual surrounding group light intensity levels.

4. The user interface of claim 1, wherein the ratio is selectable between a first ratio limit being 100% focus and 0% surrounding, and a second ratio limit being 0% focus and 100% surrounding.

5. The user interface (240) of claim 4, wherein at the first ratio limit at least one focus light source in the focus light group is set at a maximum intensity level, and at least one surrounding light source in the surrounding light group is set at a minimum intensity level; and wherein at the second ratio limit at least one focus light source in the focus light group is set at a minimum intensity level, and at least one surrounding light source in the surrounding light group is set at a maximum intensity level.

6. A method of controlling light sources configured to provide light, the method comprising the acts of:

selecting a focus light group including focus light sources by activating a scene button of a user interface, wherein remaining light sources are included in a surrounding light group;

activating a contrast switch to change a ratio of the focus light group to the surrounding light group; and activating a brightness switch to change the total illumination intensity of the focus light group and the surrounding light group by multiplying by a factor both the focus group light intensity levels of the focus light sources and surrounding group light intensity levels of the remaining light sources, wherein the focus group light sources have individual focus group light intensity levels related to each other according to a first relationship, and the remaining light sources have individual surrounding group light intensity levels related to each other according to a second relationship; and wherein the act of activating the contrast switch (430, 435) changes the ratio by multiplying the individual focus group light intensity levels by a factor (R) and simultaneously multiplying the individual surrounding group light intensity levels by an inverse of the factor (1/R) without changing the first relationship and the second relationship.

7. The method of claim 6, wherein the act of activating the brightness switch changes the total illumination intensity without changing the ratio, the first relationship, and the second first relationship.

8. The method of claim 6, wherein the act of activating the brightness switch changes the total illumination intensity without changing the ratio, the first relationship, and the second first relationship by multiplying by a factor both the individual focus group light intensity levels and the individual surrounding group light intensity levels.

9. The method of claim 6, wherein the ratio is selectable between a first ratio limit being 100% focus and 0% surrounding, and a second ratio limit being 0% focus and 100% surrounding.

10. The method of claim 9, wherein at the first ratio limit at least one focus light source in the focus group is set at a maximum intensity level, and at least one surrounding light source in the surrounding group is set at a minimum intensity level; and wherein at the second ratio limit at least one focus light source in the focus group is set at a minimum intensity level, and at least one surrounding light source in the surrounding group is set at a maximum intensity level.

* * * * *